US012778263B2

(12) United States Patent
Ohn

(10) Patent No.: US 12,778,263 B2
(45) Date of Patent: Nov. 3, 2026

(54) POWDER DISCHARGE CONTAINER HAVING AIR PUMPING PART AND AIR DISCHARGE PART

(71) Applicant: WORLD SPONGE MANUFACTURING. CO., LTD., Incheon (KR)

(72) Inventor: Sungdae Ohn, Incheon (KR)

(73) Assignee: WORLD SPONGE MANUFACTURING. CO., LTD., Incheon (KR)

( * ) Notice: Subject to any disclaimer, the term of this patent is extended or adjusted under 35 U.S.C. 154(b) by 147 days.

(21) Appl. No.: 18/268,262

(22) PCT Filed: May 24, 2022

(86) PCT No.: PCT/KR2022/007321
§ 371 (c)(1),
(2) Date: Jun. 19, 2023

(87) PCT Pub. No.: WO2023/146029
PCT Pub. Date: Aug. 3, 2023

(65) Prior Publication Data

US 2024/0389732 A1 Nov. 28, 2024

(30) Foreign Application Priority Data

Jan. 28, 2022 (KR) ..... 10-2022-0013194

(51) Int. Cl.
*A45D 33/02* (2006.01)
*A45D 24/28* (2006.01)

(52) U.S. Cl.
CPC ..... *A45D 33/02* (2013.01); *A45D 24/28* (2013.01)

(58) Field of Classification Search
CPC ..... A45D 33/02; A45D 24/28
(Continued)

(56) References Cited

U.S. PATENT DOCUMENTS 7,955,014 B2 * 6/2011 Thorpe ..... A45D 33/36 401/282
8,678,693 B2 * 3/2014 Sturgis ..... A46B 5/0095 401/286

(Continued)

FOREIGN PATENT DOCUMENTS

EP 1125519 8/2001
EP 1195106 A1 * 4/2002 ..... A45D 33/00

(Continued)

OTHER PUBLICATIONS

EPO, Search Report of EP 22905465.5 dated Apr. 9, 2025, total 6 pages.

*Primary Examiner* — Anna K Kinsaul
(74) *Attorney, Agent, or Firm* — LEX IP MEISTER, PLLC

(57) ABSTRACT

The present invention provides a powder discharge container having an air pumping part and an air discharge part, the powder discharge container including: an accommodation part (100) configured such that an upper accommodation portion (110) and a lower accommodation portion (120) are provided to communicate with each other and a filter member (140) is disposed in a powder discharge part (130); a seating part (200) disposed inside the accommodation part (100); an air pumping part (300) accommodated in the upper accommodation portion (110), and provided in the shape of a corrugated pumping structure (310); and an air discharge part (400) accommodated in the lower accommodation portion (120), and provided with a coupling portion (410) that is coupled to the bottom of the seating part (200) and the plurality of pressurization passage portions (420) that are each formed in a hollow structure under the coupling portion (410).

12 Claims, 18 Drawing Sheets

(58) Field of Classification Search
USPC ..... 132/116
See application file for complete search history.

(56) References Cited

U.S. PATENT DOCUMENTS

| | | | | |
|---|---|---|---|---|
| 2020/0138177 | A1* | 5/2020 | Godin | A45D 34/042 |
| 2021/0169199 | A1* | 6/2021 | Byun | A46B 9/021 |
| 2022/0015523 | A1 | 1/2022 | Ohn | |

FOREIGN PATENT DOCUMENTS

| | | |
|---|---|---|
| JP | 2018-534989 | 11/2018 |
| KR | 20-2010-0003246 | 3/2010 |
| KR | 10-1463718 | 11/2014 |
| KR | 20160080951 | 7/2016 |
| KR | 10-1734803 | 5/2017 |
| KR | 10-2222498 | 3/2021 |

* cited by examiner (a)

(b)

(c)

(d)

(a)

(b)

(c)

(a)

(b)

POWDER DISCHARGE CONTAINER HAVING AIR PUMPING PART AND AIR DISCHARGE PART

TECHNICAL FIELD

The present invention relates to a powder discharge container. More particularly, the present invention relates to a powder discharge container having an air pumping part and an air discharge part.

BACKGROUND ART

Recently, there have been many cases where people with severe hair loss or thinning hair spray Heukchae on their hair.

In this case, 'Heukchae' is a material in the form of black solid powder, and is used in such a manner as to be sprayed on hair more conveniently than wigs useful for people without hair or with thinning hair.

However, the prior art is configured such that Heukchae is sprayed on the outside of the hair, and thus, has a problem in that Heukchae is not evenly sprayed on the inside of the hair.

In addition, there is a problem in that the powder (Heukchae) accommodated inside a container is not discharged in an even particle size but is discharged in a sticking state.

DISCLOSURE

Technical Problem

A powder discharge container having an air pumping part and an air discharge part according to the present invention has the following objects:

- A first object is to allow the powder stored in an accommodation part to be easily discharged.
- A second object is to prevent the powder stored in the accommodation part from sticking.
- A third object is to enable the amount of powder discharged from the accommodation part to be controlled.

The objects of the present invention are not limited to those mentioned above, and other objects not mentioned above will be clearly understood by those skilled in the art from the following description.

Technical Solution

The present invention provides a powder discharge container having an air pumping part and an air discharge part, the powder discharge container including: an accommodation part configured such that an upper accommodation portion having an open top and a lower accommodation portion having a powder discharge part in the bottom thereof are provided to communicate with each other and a filter member is disposed in the powder discharge part; a seating part disposed inside the accommodation part, and provided with a central hole; an air pumping part accommodated in the upper accommodation portion, provided in the shape of a corrugated pumping structure, and provided with an open bottom end that is coupled to the top of the seating part; and an air discharge part accommodated in the lower accommodation portion, and provided with a coupling portion that is coupled to the bottom of the seating part and a plurality of pressurization passage portions that are each formed in a hollow structure under the coupling portion; wherein the air pumped by the air pumping part is discharged to the lower accommodation portion through at least one air discharge of holes formed in the pressurization passage portions, and the powder accommodated in the lower accommodation portion is discharged through the filter member.

In the present invention, the filter member may be provided as a mesh structure or a porous structure, and may be configured to allow powder having a predetermined size to pass through the filter member itself.

In the present invention, the powder may be introduced into the lower accommodation portion after the filter member has been removed, and the filter member may be coupled back when the introduction of the powder is completed.

In the present invention, ends of the pressurization passage portions may be spaced apart from the filter member.

In the present invention, the pressurization passage portions may be provided to have the same length as each other.

In the present invention, the pressurization passage portions may be provided as a group of passage portions having different lengths.

In the present invention, each of the air discharge holes of the pressurization passage portions may be provided in at least one of an end and side of a corresponding one of the pressurization passage portions.

In the present invention, ends of the pressurization passage portions may be bent ends that are provided to be bent.

In the present invention, a plurality of protrusions may be provided on the outer surfaces of the pressurization passage portions.

In the present invention, partition pillar portions may be coupled to the outer periphery of the air discharge part.

In the present invention, the outer surface of the accommodation part may be provided with an outer cover part having a through hole in the top thereof.

In the present invention, a pressing member may be inserted into the through hole of the outer cover, so that when the pressing member is pressed, the corrugated pumping structure is pressed.

In the present invention, a lid part may be coupled to the lower accommodation portion.

In the present invention, protruding powder outlet stopper may be provided on the bottom surface of the lower accommodation portion.

Advantageous Effects

The powder discharge container having an air pumping part and an air discharge part according to the present invention has the following effects:

- First, there is an effect in that the powder stored in the accommodation part is easily discharged using the air pumping part.
- Second, there is an effect in that the powder stored in the accommodation part is prevented from sticking through the configurations of the height difference, bent ends and protrusions of the pressurization passage portion.
- Third, there is an effect in that the amount of powder discharged from the accommodation part is controlled and excessive discharge is prevented using the air pumping part.

The effects of the present invention are not limited to those mentioned above, and other effects not mentioned above will be clearly understood by those skilled in the art from the following description.

Figure 1A:
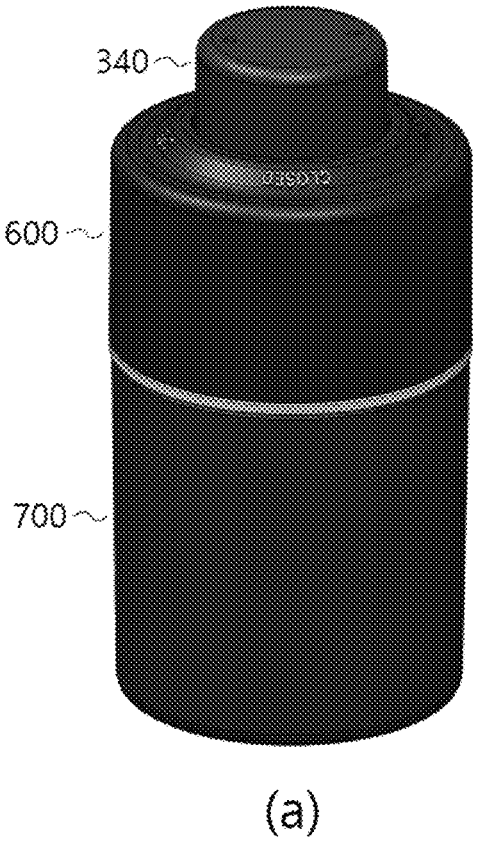
FIG. 1*a* shows the appearance of a state in which a lid part is coupled to a powder discharge container according to the present invention.

100: accommodation part 110: upper accommodation portion
120: lower accommodation portion 130: powder discharge part
140: filter member
200: seating part 210: central hole
300: air pumping part 310: corrugated pumping structure
320: open end 330: closed end
340: pressing member
400: air discharge part 410: coupling portion
420: pressurization passage portion 421: air discharge hole
430: bent end 440: protrusions
500: partition pillar portions 600: outer cover part
700: lid part 710: powder outlet stopper

BEST MODE

The present invention provides a powder discharge container having an air pumping part and an air discharge part, the powder discharge container including: an accommodation part configured such that an upper accommodation portion having an open top and a lower accommodation portion having a powder discharge part in the bottom thereof are provided to communicate with each other and a filter member is disposed in the powder discharge part; a seating part disposed inside the accommodation part, and provided with a central hole; an air pumping part accommodated in the upper accommodation portion, provided in the shape of a corrugated pumping structure, and provided with an open bottom end that is coupled to the top of the seating part; and an air discharge part accommodated in the lower accommodation portion, and provided with a coupling portion that is coupled to the bottom of the seating part and a plurality of pressurization passage portions that are each formed in a hollow structure under the coupling portion; wherein the air pumped by the air pumping part is discharged to the lower accommodation portion through at least one of air discharge holes formed in the pressurization passage portions, and the powder accommodated in the lower accommodation portion is discharged through the filter member.

MODE FOR INVENTION

Hereinafter, embodiments of the present invention will be described with reference to the accompanying drawings so that those of ordinary skill in the art to which the present invention pertains can easily practice the present invention. As can be easily understood by those of ordinary skill in the art to which the present invention pertains, the following embodiments may be modified in various forms without departing from the spirit and scope of the present invention. Throughout the drawings, identical or similar parts are denoted with the same reference numerals as much as possible.

The terminology used in this specification is employed only for referring to specific embodiments and is not intended to limit the present invention. Each singular form used herein also includes a plural form unless the phrases clearly indicate the opposite.

The meaning of "including" used herein is intended to specify one or more particular characteristics, regions, integers, steps, operations, elements, and/or components, and is not intended to exclude the presence or addition of one or more other specific characteristics, regions, integers, steps, operations, elements, components, and/or groups thereof.

All the terms including the technical and scientific terms used herein have the same meanings as commonly understood by those of ordinary skill in the art to which the present invention pertains. The terms defined in the dictionary are additionally interpreted as having meanings consistent with the related technical literature and the currently disclosed content, and are not interpreted in ideal or excessively formal senses unless defined so.

The terms related to directions used in this specification, for example, terms of front/back/left/right, upper/lower, longitudinal/lateral directions, etc., may be interpreted with reference to the directions disclosed in the accompanying drawings.

The present invention is directed to a powder discharge container for storing and discharging powder. Although the present invention will be described by taking a hair dye (Heukchae) in a powder form as an example below, the powder according to the present invention is not limited to the hair dye (Heukchae).

The present invention has a structure in which an air pumping part is provided in the upper portion of an accommodation part, powder is accommodated (stored) in the lower space of the accommodation part, and an air discharge part is provided in the lower space of the accommodation part.

The air pressurized by the pumping of the air pumping part 300 may be discharged to the lower accommodation portion 120 through the air discharge part 400, the discharged air may cause the powder stored in the lower accommodation portion 120 to flow, and the powder may be discharged to the outside through the powder discharge part 130 and filter member 140 of the lower accommodation portion 120.

The flowing powder, together with the pressurized air, is not only discharged to the outside, but may also be pulverized while colliding with each other, with the filter member 140, and/or with pressurization passage portions 420 during a flow process.

Hereinafter, the present invention will be described with reference to the drawings. For reference, the drawings may be partially exaggerated in order to describe the features of the present invention. In this case, it is preferable to make interpretations in light of the overall purport of the present specification.

Figure 1B:
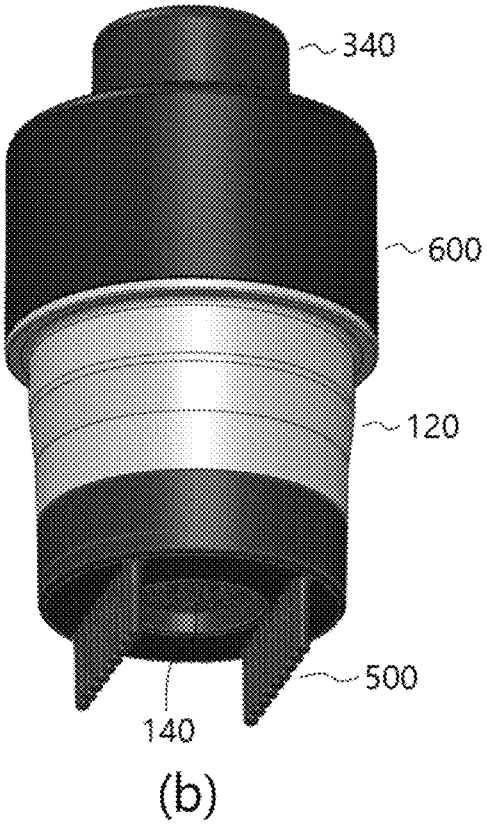
FIG. 1*b* shows a state in which the lid part is removed from the powder discharge container.

FIG. 1*a* shows the appearance of a state in which a lid part is coupled to the powder discharge container according to the present invention, and FIG. 1*b* shows a state in which the lid part is removed from the powder discharge container.

Figure 2:
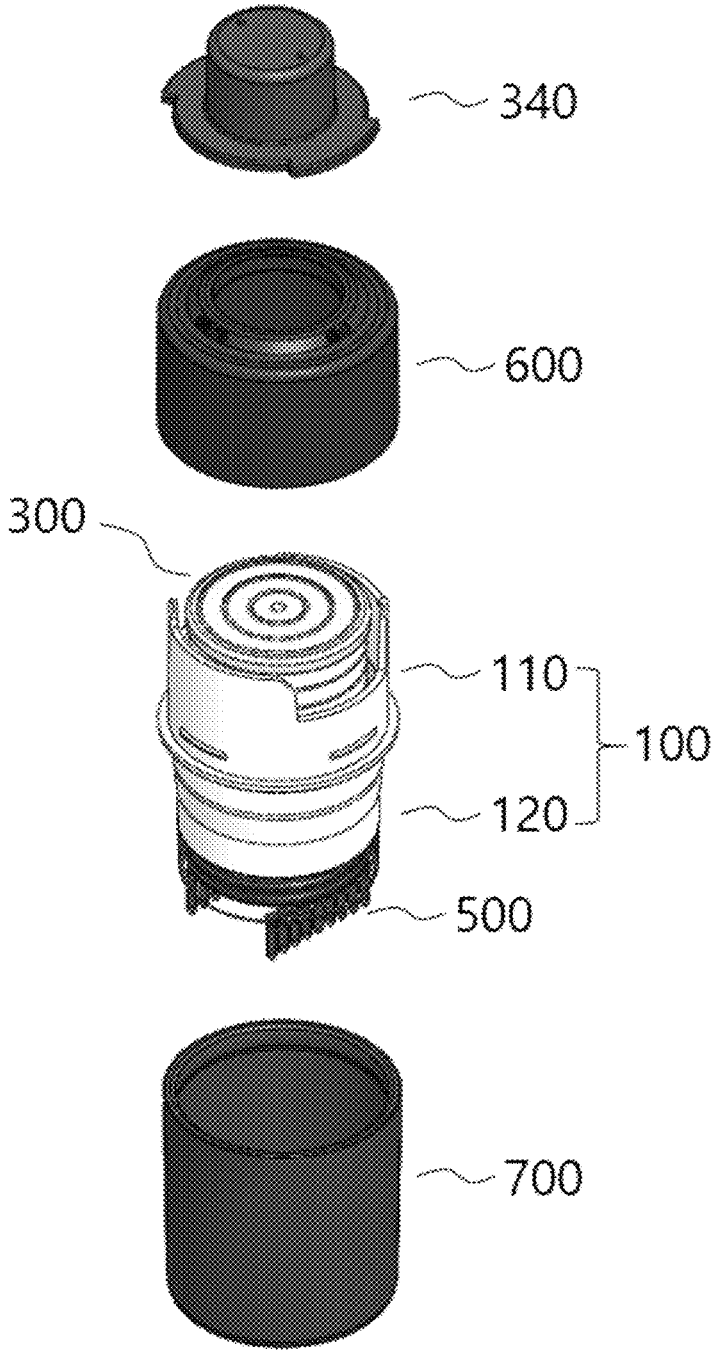
FIG. 2 is an exploded perspective view of the powder discharge container according to the present invention.
Figure 3:
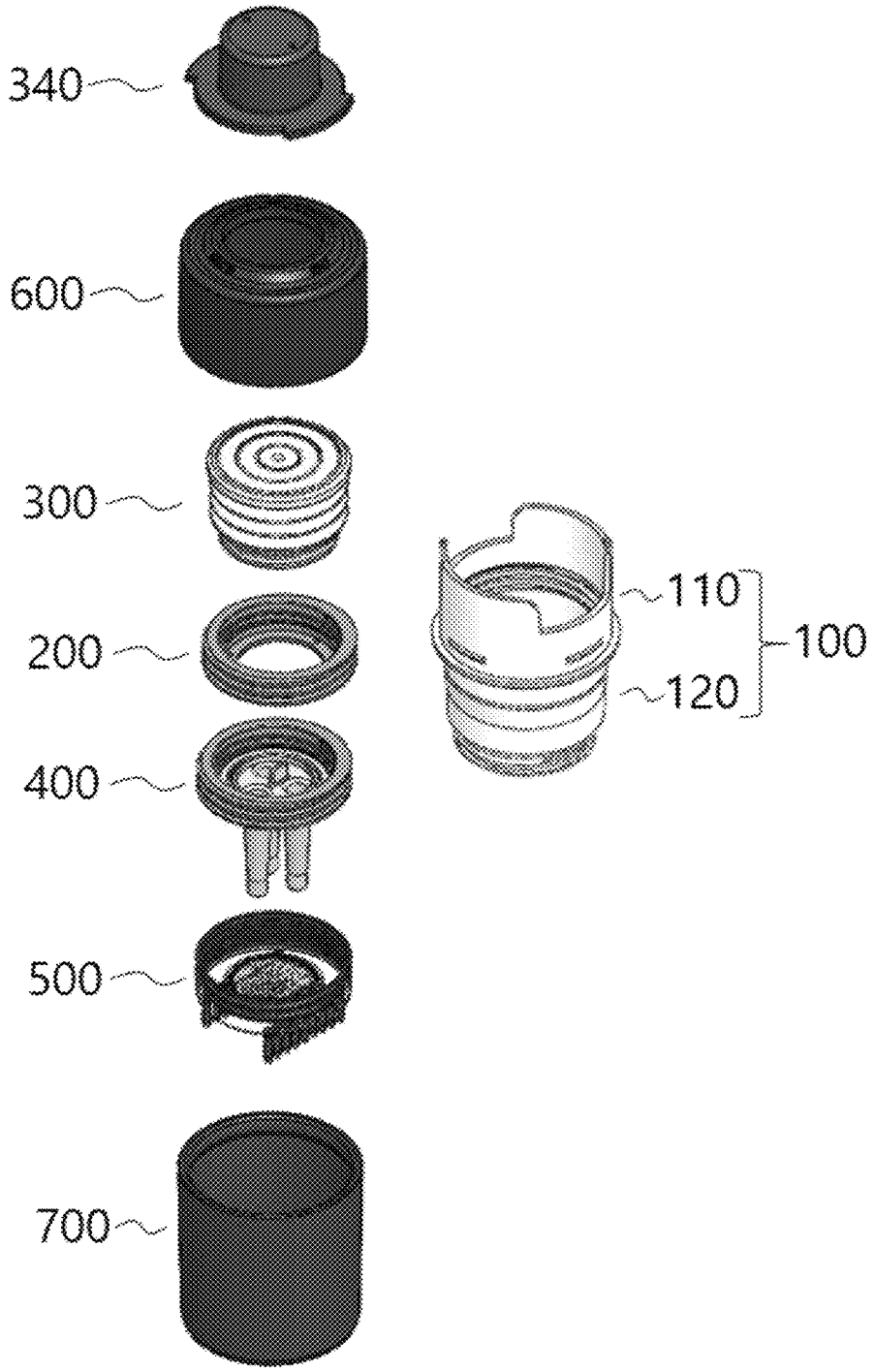
FIG. 3 is a detailed exploded perspective view in which the inside of an accommodation part is additionally exploded in the exploded view of FIG. 2.
Figure 4:
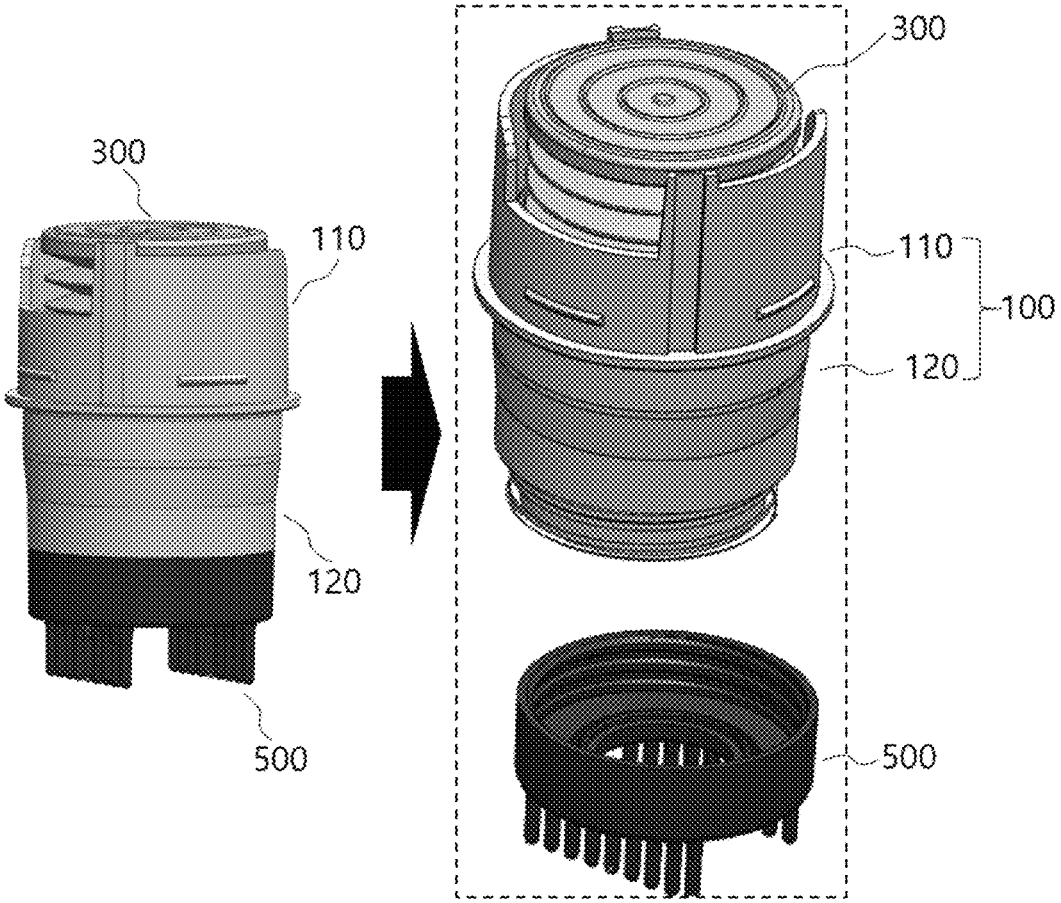
FIG. 4 shows a structure in which the accommodation part, an air pumping part, and partition pillar portions according to the present invention are combined together and disassembled.
Figure 5:
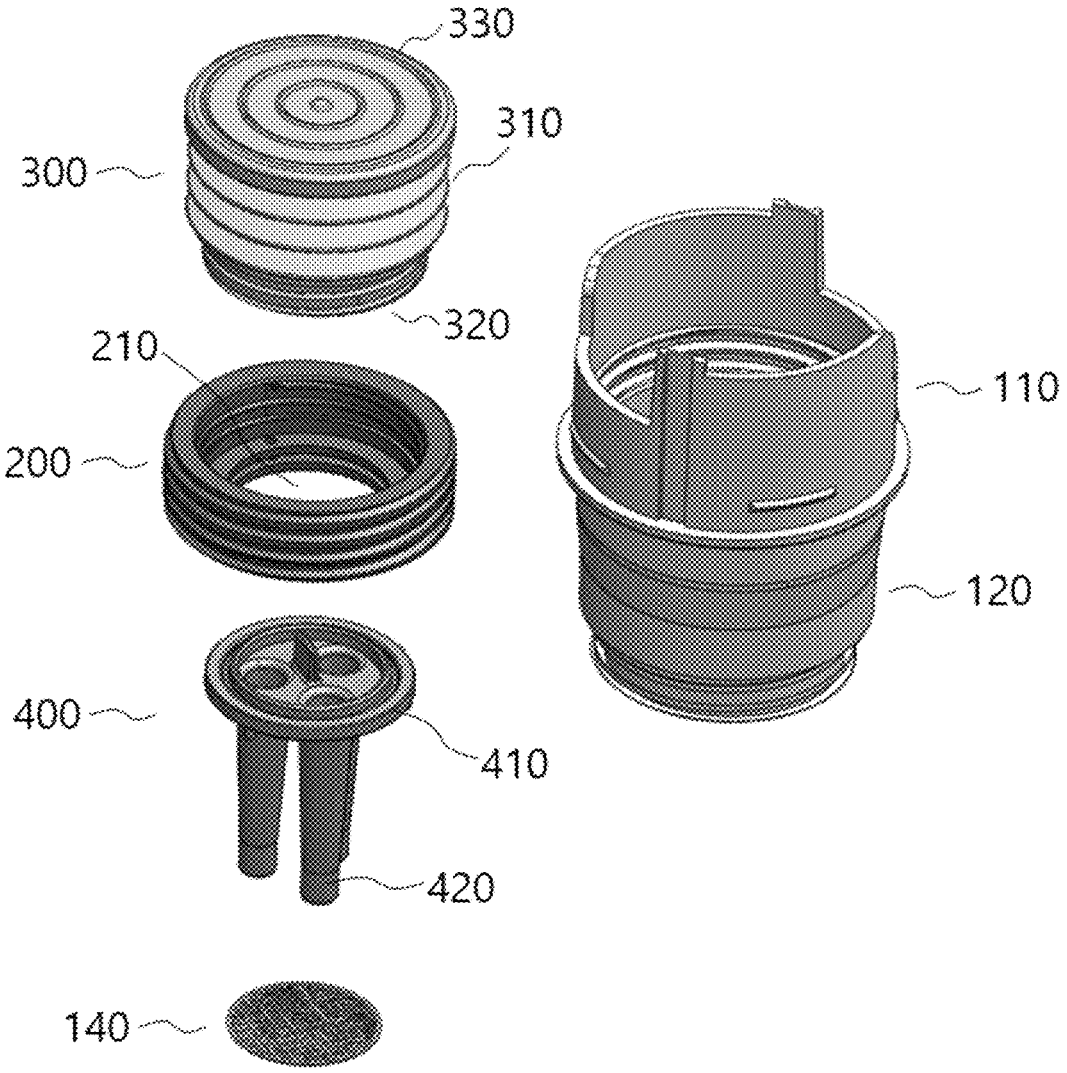
FIG. 5 is an exploded perspective view of a seating part, the air pumping part, an air discharge part, and a filter member disposed in the accommodation part according to the present invention.
Figure 6:
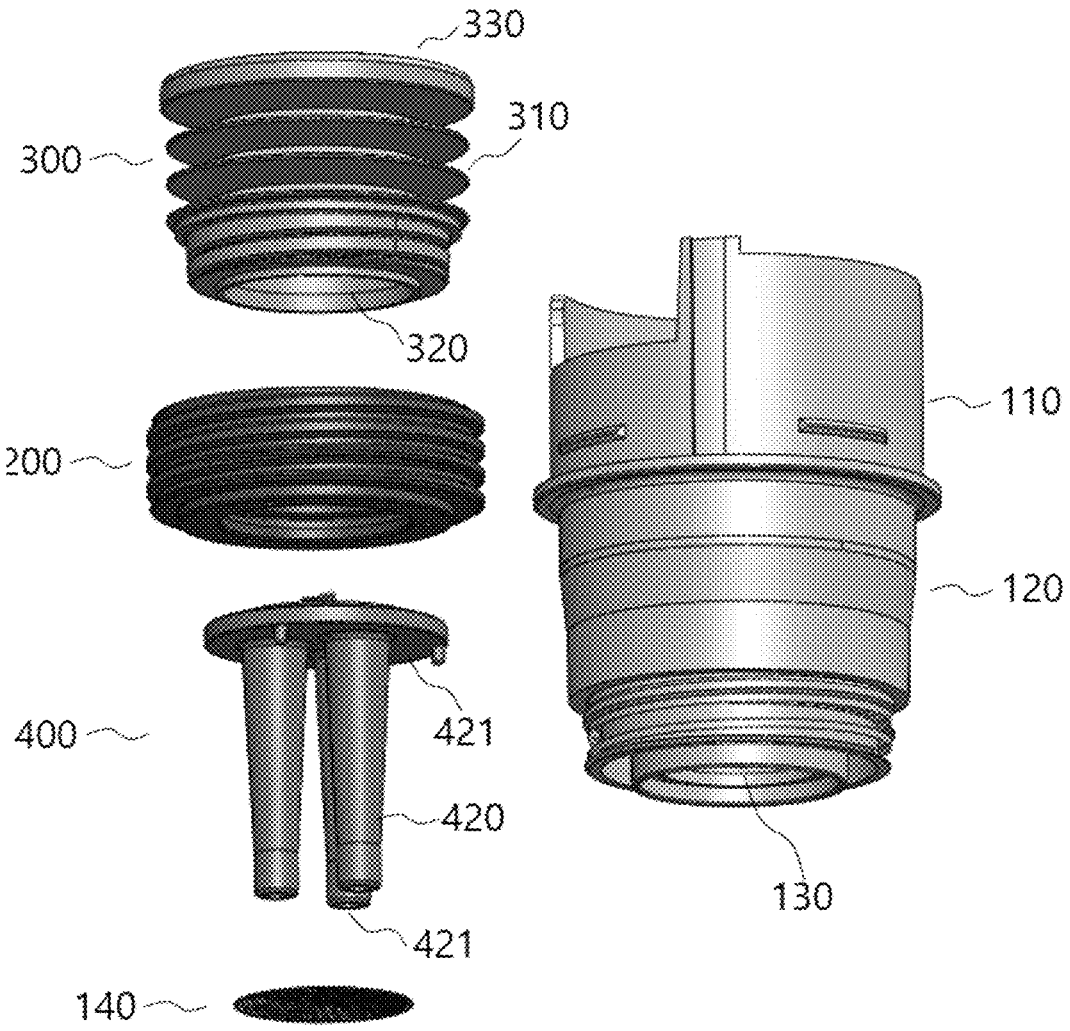
FIG. 6 is an exploded perspective view of FIG. 5 viewed from another angle.
Figure 7:
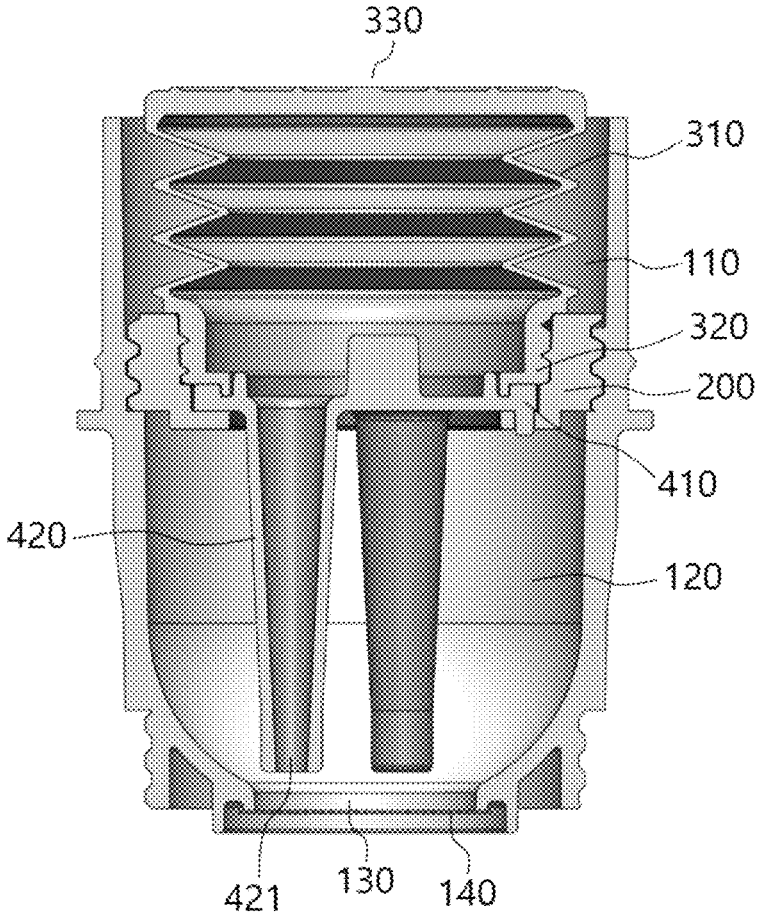
FIG. 7 is a front sectional view of a structure in which the accommodation part, the seating part, the air pumping part, and the air discharge part according to the present invention are combined together.

FIG. 2 is an exploded perspective view of the powder discharge container according to the present invention. FIG. 3 is a detailed exploded perspective view in which the inside of the accommodation part is additionally exploded in the exploded view of FIG. 2.

As shown in FIG. 3, the powder discharge container having an air pumping part and an air discharge part according to the present invention includes an accommodation part 100, a seating part 200, an air pumping part 300, and an air discharge part 400.

The powder discharge container having an air pumping part and an air discharge part according to the present invention includes: the accommodation part 100 configured such that an upper accommodation portion 110 having an open top and a lower accommodation portion 120 having the powder discharge part 130 in the bottom thereof are provided to communicate with each other and the filter member 140 is disposed in the powder discharge part 130; the seating part 200 disposed inside the accommodation part 100 and provided with a central hole 210; the air pumping part 300 accommodated in the upper accommodation portion 110, provided in the shape of a corrugated pumping structure 310, and provided with an open bottom end 320 that is coupled to the top of the seating part 200; and the air discharge part 400 accommodated in the lower accommodation portion 120, and provided with a coupling portion 410 that is coupled to the bottom of the seating part 200 and the plurality of pressurization passage portions 420 that are each formed in a hollow structure under the coupling portion 410.

In the present invention, the air pumped by the air pumping part 300 may be discharged to the lower accommodation portion 120 through at least one of the air discharge holes 421 formed in the pressurization passage portions 420, and the powder accommodated in the lower accommodation portion 120 may be discharged through the filter member 140.

The air pumping part 300 disposed inside the upper accommodation portion 110 is provided as the corrugated pumping structure 310. Accordingly, when a closed end 330 on the top of the air pumping part 300 is repeatedly pressed, air may be moved downward through a process in which the corrugations of the corrugated pumping structure 310 are folded and unfolded.

The air moved downward is moved to the pressurization passage portions 420 of the air discharge part 400, and is discharged through the air discharge holes 421.

The place where air is discharged is the lower accommodation portion 120 in which powder is stored, and the powder discharge part 130 is provided in the bottom of the lower accommodation portion 120. The pressurized air is discharged to the outside through the powder discharge part 130 together with the stored powder.

In this case, it is preferable to dispose the filter member 140 in the powder discharge part 130 so that only powder having a predetermined powder size or less is discharged.

In the present invention, the powder may be introduced into the lower accommodation portion 120 after the filter member 140 has been removed, and the filter member 140 may be coupled back when the introduction of the powder is completed (see FIGS. 14*a* to 14*d*).

In the present invention, the filter member 140 may be provided as a mesh structure or a porous structure. The powder (material) accommodated in the lower accommodation portion 120 may stick to each other and form lumps over time. Since the sticking of the powder prevents the power from being in the original state of the powder, it reduces the function (a hair dyeing function, and/or the like) of discharged powder, also interferes with discharge, and further acts as a factor hindering quantitative discharge.

Accordingly, in the present invention, the powder may be discharged through the filter member 140 so that only powder having a predetermined size or less is discharged.

In addition, in the present invention, the function of pulverizing the powder may be performed using air used to discharge the powder.

In the present invention, ends of the pressurization passage portions 420 are spaced apart from the filter member 140, and the space formed by the spaced arrangement functions as a powder pulverization space.

Figure 10:
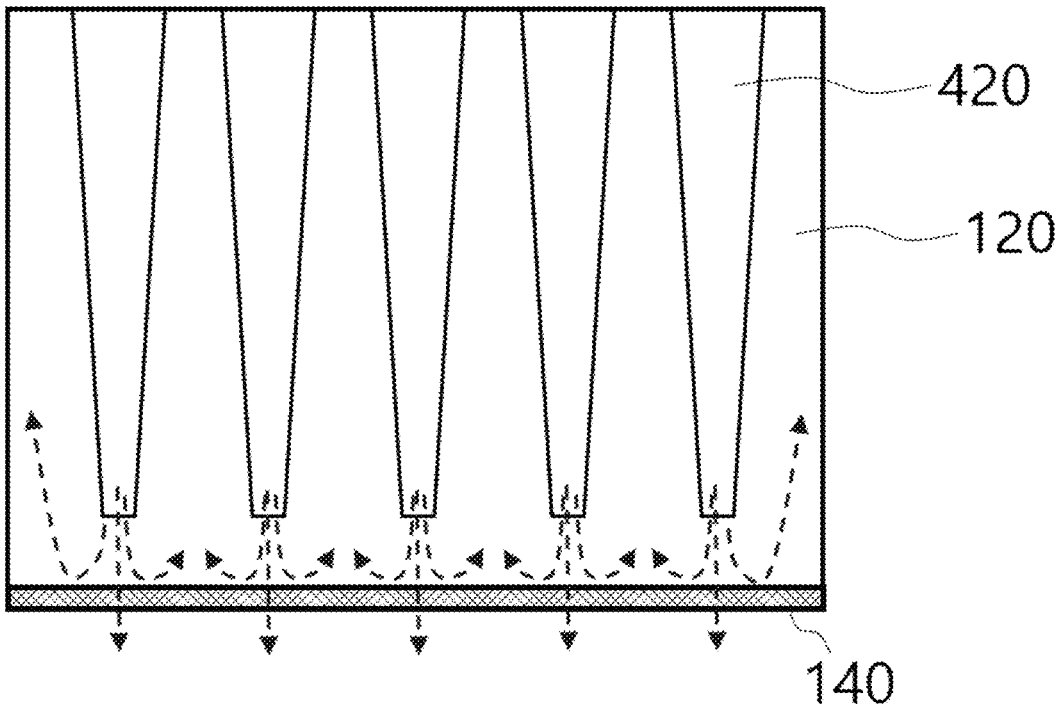
FIG. 10 shows an embodiment in which the lengths of pressure passage portions are the same in the powder discharge container according to the present invention.

As a first embodiment, the pressurization passage portions 420 according to the present invention may be provided to have the same length as each other. FIG. 10 shows an embodiment in which the lengths of the pressure passage portions 420 are the same in the powder discharge container according to the present invention.

Referring to FIG. 10, the air discharged through the air discharge holes 421 of the pressurization passage portions 420 moves to the filter member 140 together with the powder. In this case, when the size of the powder is larger than the size allowed by the filter member 140, the powder cannot pass through the filter member 140, and the powder sticking together may be pulverized by collisions.

Figure 11:
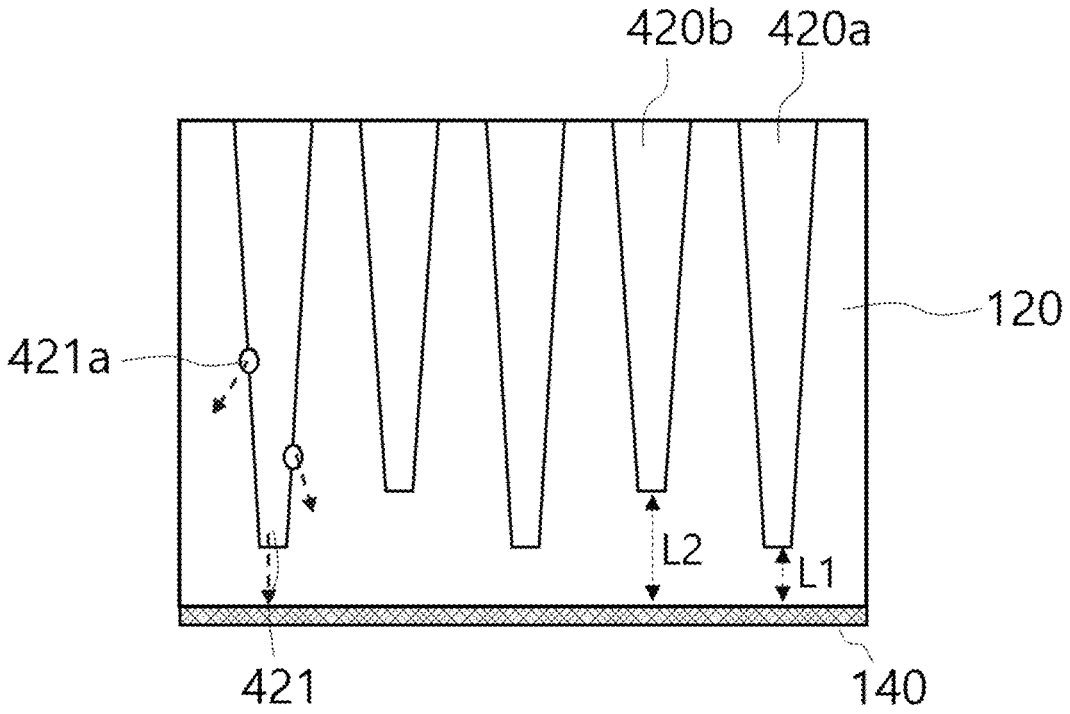
FIG. 11 shows an embodiment including a group of pressurization passage portions having different lengths in the powder discharge container according to the present invention.

As a second embodiment, the pressurization passage portions 420 according to the present invention may be provided as a group of passage portions having different lengths. FIG. 11 shows an embodiment including a group of pressurization passage portions 420 having different lengths in the powder discharge container according to the present invention.

Referring to FIG. 11, the separation distance between a relatively long pressurization passage portion 420*a* and a filter member 140 is L1. The separation distance between a relatively short pressure passage portion 420*b* and the filter member 140 is L2. In the case of the second embodiment, a larger space is obtained between an air discharge hole 421 and the filter member 140 at the separation distance L2. Therefore, more flows of air are generated, and thus the pulverization of the powder may be performed more smoothly.

As a third embodiment, each of the air discharge holes 421 of the pressurization passage portions 420 according to the present invention may be provided in at least one of an end and side of a corresponding one of the pressurization passage portions.

FIG. 11 shows an embodiment including a group of pressurization passage portions 420 having different lengths in the powder discharge container according to the present invention. In FIG. 11, there are illustrated air discharge holes 421 provided at the bottom ends of the pressurization passage portions 420 and air discharge holes 421*a* provided in the side portion.

The air discharge holes 421*a* formed in the side portions perform the function of promoting the flow of air and the pulverization and mixing of the powder not only in the mixing space formed at the separation distances L1 and L2 but also in the lower accommodation portion 120 in which the powder is accommodated.

As a fourth embodiment, ends of pressurization passage portions 420 according to the present invention may be bent ends 430 that are provided to be bent.

Figure 12:
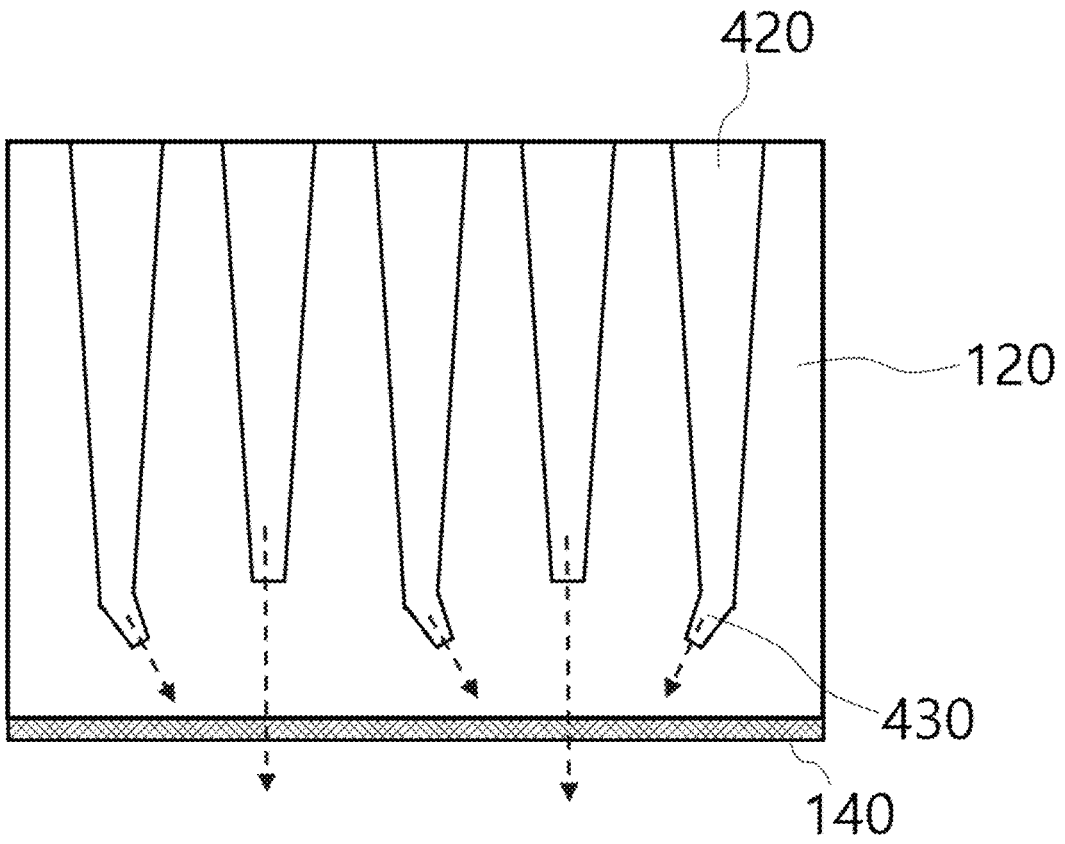
FIG. 12 shows an embodiment in which bent ends of pressurization passage portions are provided in the powder discharge container according to the present invention.

FIG. 12 shows an embodiment in which bent ends 430 of pressurization passage portions are provided in the powder discharge container according to the present invention.

The bent ends 430 according to the present invention may be provided in the same direction or in different directions. As shown in FIG. 12, the air discharged from the pressurization passage portions 420 through the bent ends 430 may be discharged in various directions. This configuration may perform the function of crushing the powder by generating collisions between the particles of the powder.

In the case of FIG. 12, the second embodiment and the fourth embodiment are combined together. As described above, multiple embodiments may be implemented individually or in combination.

As a fifth embodiment, a plurality of protrusions 440 may be provided on the outer surfaces of pressurization passage portions 420 according to the present invention.

Figure 13:
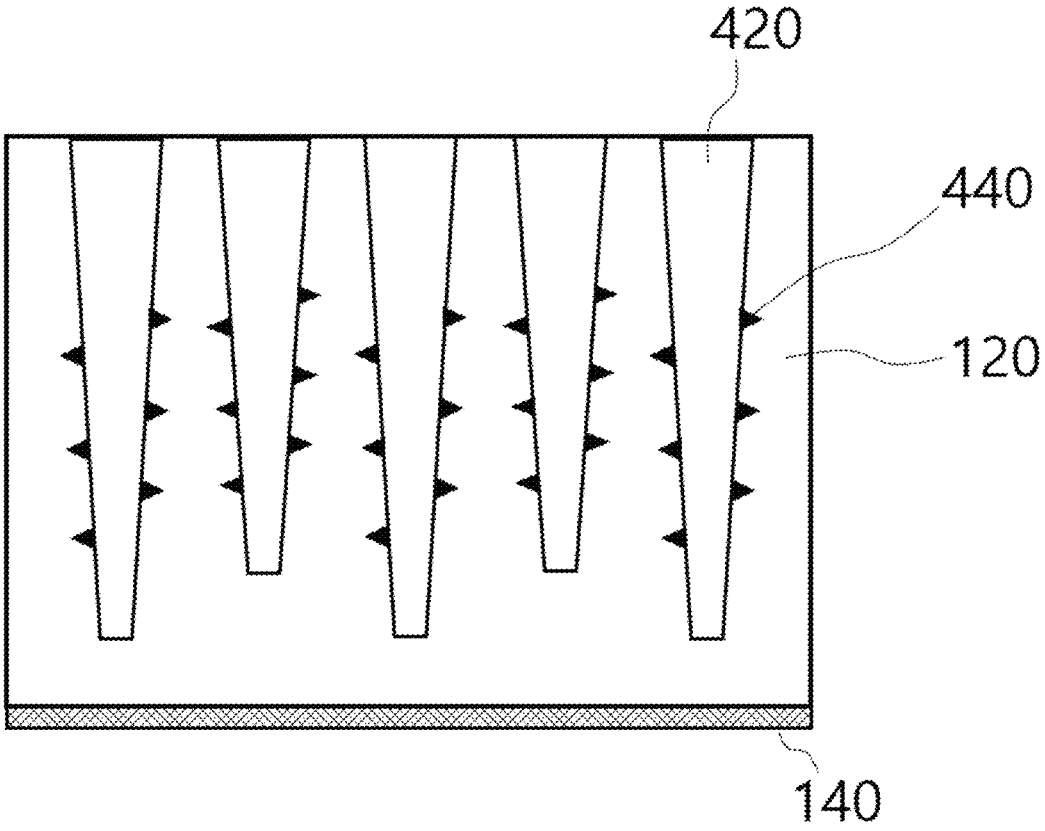
FIG. 13 shows an embodiment in which a plurality of protrusions are provided on the outer surfaces of the pressurization passage portions in the powder discharge container according to the present invention.
Figure 14A:
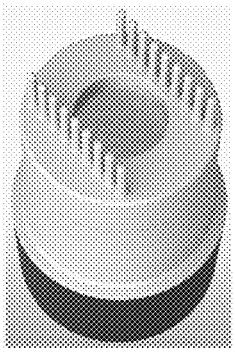
FIGS. 14*a* to 14*d* show a process in which powder is accommodated in the lower accommodation portion in the powder discharge container according to the present invention.
Figure 14B:
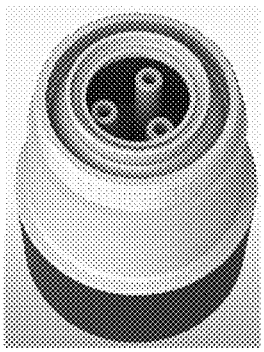
Figure 14C:
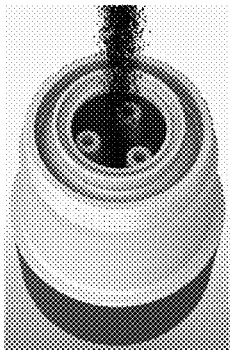
Figure 14D:
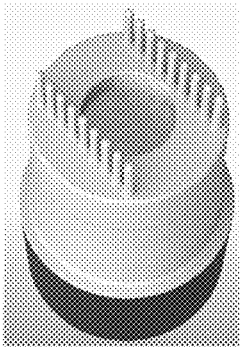

FIG. 13 shows an embodiment in which a plurality of protrusions 440 are provided on the outer surfaces of the pressurization passage portions in the powder discharge container according to the present invention.

When air is discharged into the lower accommodation portion 120, the air and the powder flow together. At this time, the powder may collide with the outer surfaces of the pressurization passage portions 420. In this case, when the plurality of protrusions 440 are provided on the outer surfaces of the pressurization passage portions 420, the powder may be more desirably pulverized.

In the present invention, partition pillar portions 500 may be coupled to the outer periphery of the air discharge part 400.

Air and the powder are discharged through the filter member 140. If they are distributed left and right after being discharged, it may be difficult to perform accurate discharge at a location desired by a user.

Figure 8:
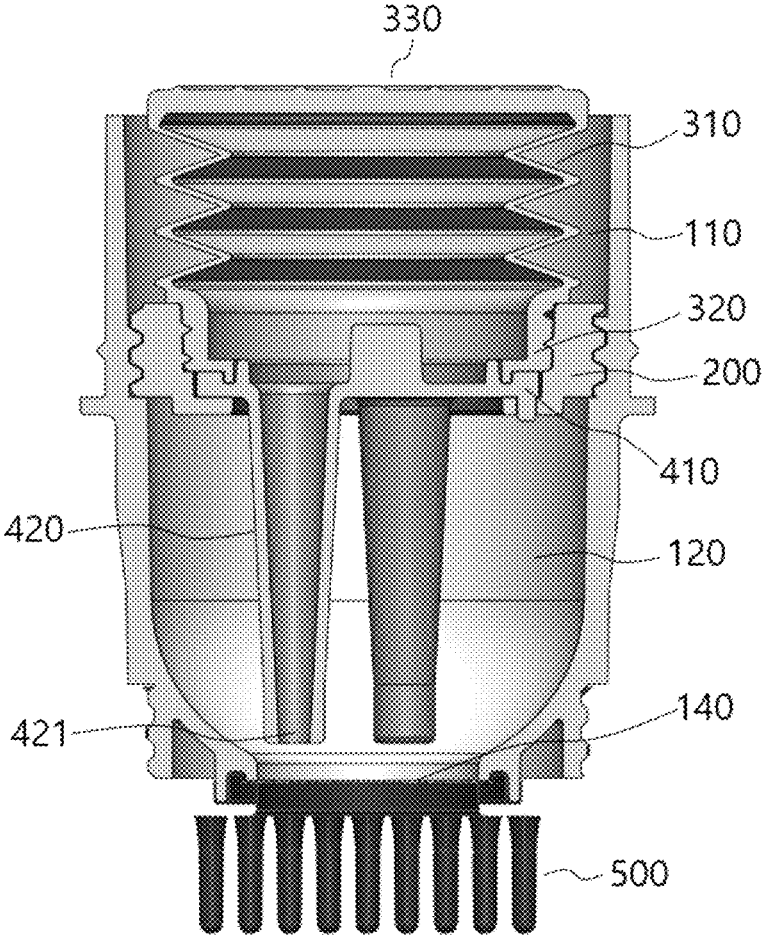
FIG. 8 is a front sectional view of a structure in which the partition pillar portions are added to FIG. 7.
Figure 9:
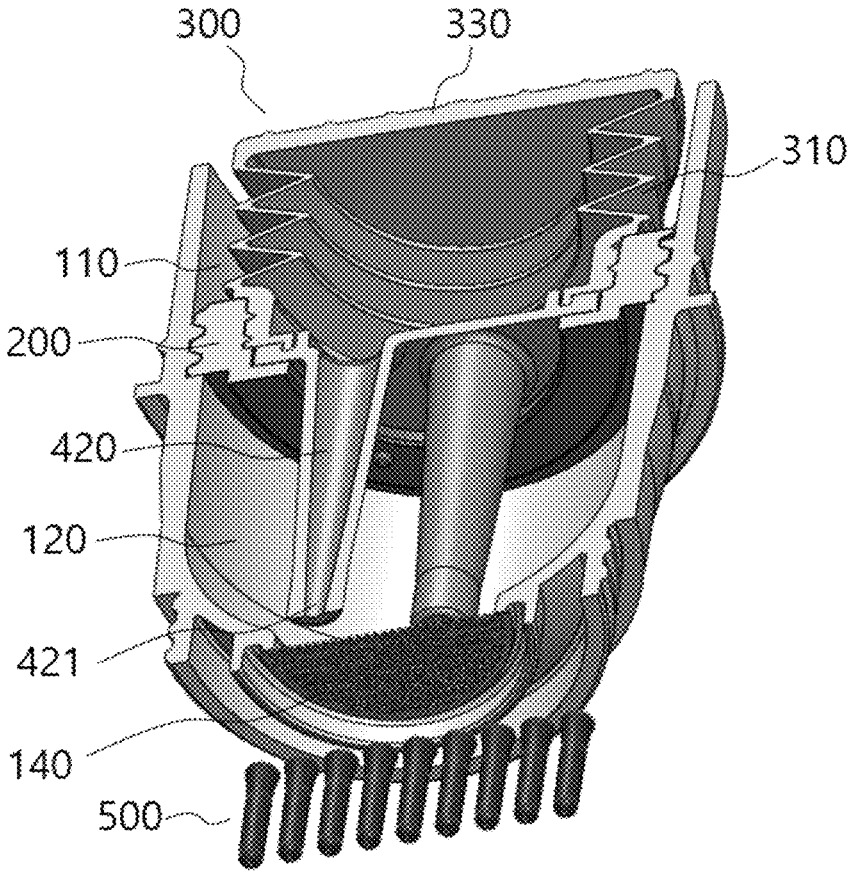
FIG. 9 is a sectional view of FIG. 8 viewed from another angle.

Accordingly, as shown in FIGS. 8 and 9, the plurality of partition pillar portions 500 may be spaced apart from each other on the outer periphery of the powder discharge part 130 and the filter member 140.

Figure 15A:
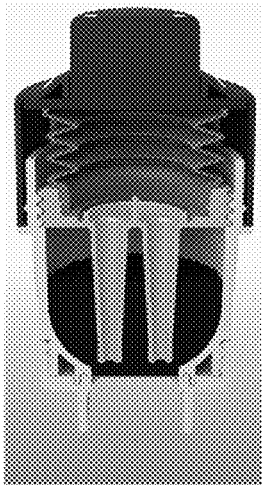
FIGS. 15*a* and 15*b* show an embodiment in which the powder accommodated in the lower accommodation portion is discharged through the filter member by the pumping of the air pumping part.
Figure 15B:
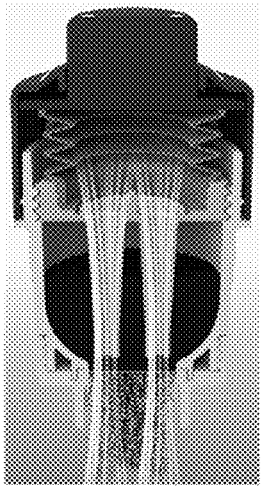
Figure 15C:
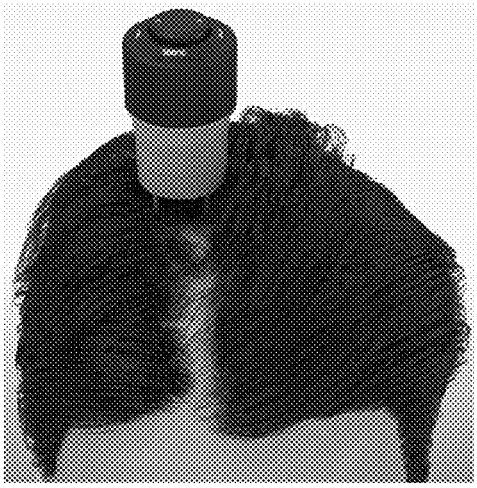
FIG. 15*c* shows an embodiment in which a hair dye (Heukchae) is sprayed on a user's hair as an example of the powder.

Since the plurality of partition pillar portions may function as combs, the user may move the partition pillar portions laterally (see FIG. 15*c*) as if combing after distributing the powder (see FIGS. 15*a* and 15*b*). The powder discharged through this process may be applied to a location desired by a user.

Figure 16A:
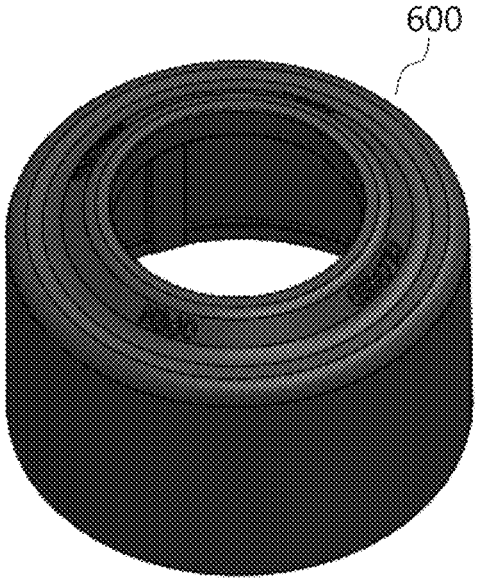
FIGS. 16*a* and 16*b* show an outer cover part according to the present invention.
Figure 16B:
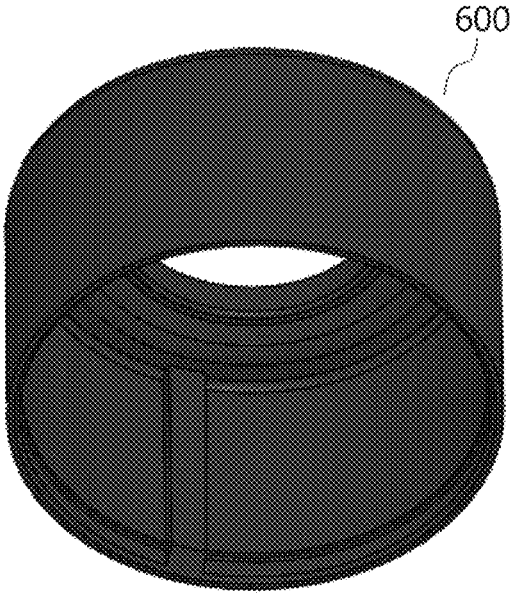

In the present invention, the outer surface of the accommodation part 100 may be provided with an outer cover part 600 having a through hole 610 in the top thereof. FIGS. 16*a* and 16*b* show an outer cover part according to the present invention.

Figure 17A:
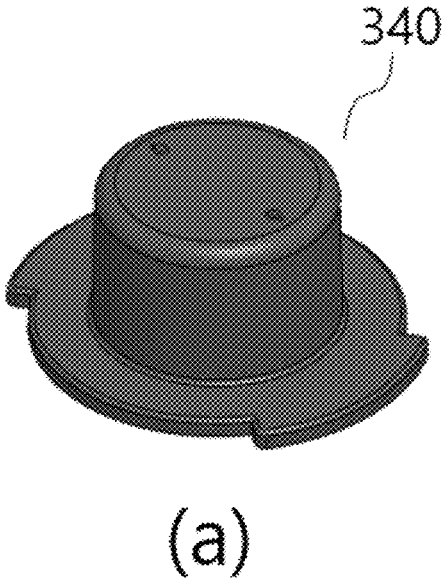
FIGS. 17*a* and 17*b* show a pressing member according to the present invention.
Figure 17B:
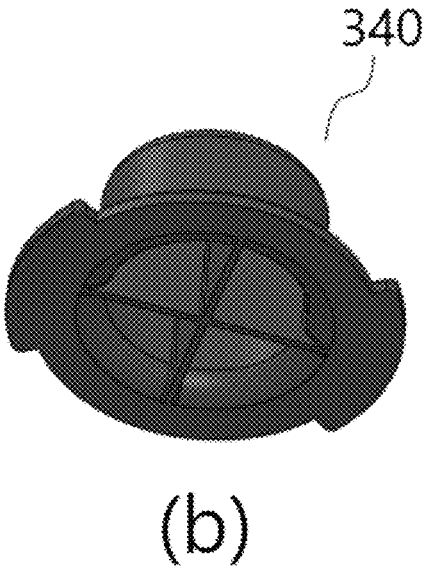

In the present invention, a pressing member 340 is inserted into the through hole 610 of the outer cover 600. Accordingly, when the pressing member 340 is pressed, the corrugated pumping structure 310 may be pressed. FIGS. 17*a* and 17*b* show a pressing member according to the present invention.

Figures 18A, 18B, 18C:
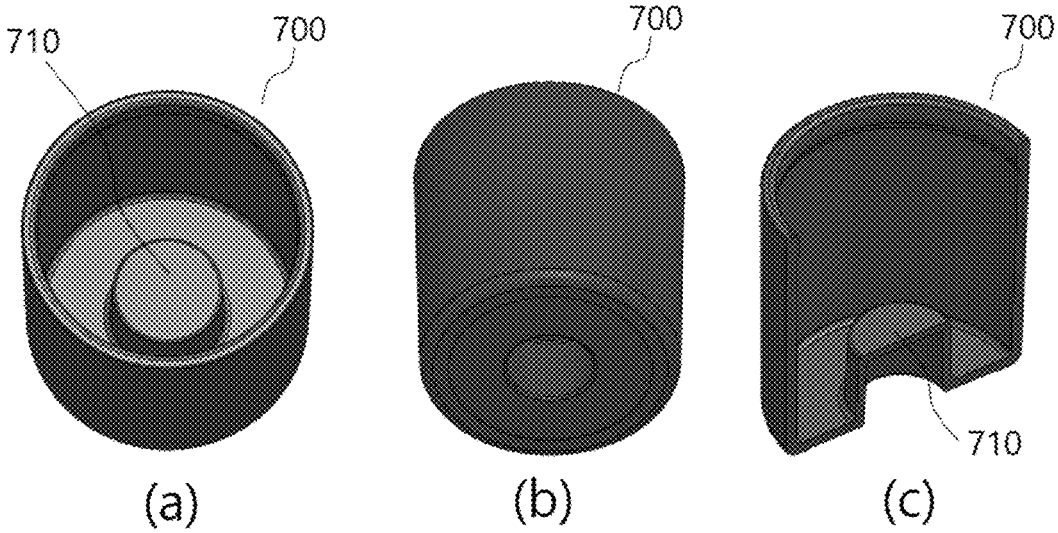
FIGS. 18*a* to 18*c* show a lid part according to the present invention.

In the present invention, a lid part 700 may be coupled to the lower accommodation portion 120. A protruding powder outlet stopper 710 may be provided on the bottom surface of the lower accommodation portion 120. FIGS. 18*a* to 18*c* show the lid part according to the present invention.

The embodiments described herein and the accompanying drawings merely illustrate some of the technical spirit included in the present invention by way of example. Therefore, the embodiments disclosed herein are intended to describe the technical spirit of the present invention rather than to limit it, so that it is obvious that the scope of the technical spirit of the present invention is not limited by these embodiments. All the modifications and specific embodiments that may be easily inferred by those skilled in the art within the scope of the technical spirit included in the present specification and accompanying drawings of the present invention should be construed as falling within the scope of the present invention.

The invention claimed is:

1. A powder discharge container having an air pumping part and an air discharge part, the powder discharge container comprising:

an accommodation part configured such that an upper accommodation portion having an open top and a lower accommodation portion having a powder discharge part in a bottom thereof are provided to communicate with each other and a filter member is disposed in the powder discharge part;

a seating part disposed inside the accommodation part, and provided with a central hole;

the air pumping part accommodated in the upper accommodation portion, provided as a corrugated pumping structure, and provided with an open bottom end that is coupled to a top of the seating part; and the air discharge part accommodated in the lower accommodation portion, and provided with a coupling portion that is coupled to a bottom of the seating part and a plurality of pressurization passage portions that are each formed in a hollow structure under the coupling portion;

wherein air pumped by the air pumping part is discharged to the lower accommodation portion through at least one of air discharge holes formed in the pressurization passage portions, and powder accommodated in the lower accommodation portion is discharged through the filter member, wherein each of the plurality of pressurization passage portions has only one air discharge hole which is located at an end of the pressurization passage portion, wherein the plurality of pressurization passage portions include a first pressurization passage portion and a second pressurization passage portion, wherein the first pressurization passage portion has a bent end which is bent in a different direction from an extending direction of the first pressurization passage portion, wherein the second pressurization passage portion has an end which has the same direction as an extending direction of the second pressurization passage portion.

2. The powder discharge container of claim 1, wherein the filter member:

is provided as a mesh structure or a porous structure; and is configured to allow powder having a predetermined size to pass through the filter member itself.

3. The powder discharge container of claim 1, wherein the powder is introduced into the lower accommodation portion after the filter member has been removed, and the filter member is coupled back when an introduction of the powder is completed.

4. The powder discharge container of claim 1, wherein ends of the pressurization passage portions are spaced apart from the filter member.

5. The powder discharge container of claim 1, wherein the pressurization passage portions are provided to have a same length as each other.

6. The powder discharge container of claim 1, wherein the pressurization passage portions are provided as a group of passage portions having different lengths.

7. The powder discharge container of claim 1, wherein a plurality of protrusions are provided on outer surfaces of the pressurization passage portions.

8. The powder discharge container of claim 1, wherein partition pillar portions are coupled to an outer periphery of the air discharge part.

9. The powder discharge container of claim 1, wherein an outer surface of the accommodation part is provided with an outer cover part having a through hole in a top thereof.

10. The powder discharge container of claim 9, wherein:

a pressing member is inserted into the through hole of the outer cover, so that when the pressing member is pressed, the corrugated pumping structure is pressed.

11. The powder discharge container of claim 1, wherein a lid part is coupled to the lower accommodation portion.

12. The powder discharge container of claim 11, wherein a protruding powder outlet stopper is provided on a bottom surface of the lower accommodation portion.

* * * * *